United States Patent [19]

Suzuki

[11] Patent Number: 4,800,244

[45] Date of Patent: Jan. 24, 1989

[54] PRESSURE SWITCH

[75] Inventor: Masaru Suzuki, Aichi, Japan

[73] Assignee: Kabushiki Kaisha Tokai Rika Denki Seisakusho, Aichi, Japan

[21] Appl. No.: 784,468

[22] Filed: Oct. 4, 1985

Related U.S. Application Data

[62] Division of Ser. No. 662,890, Oct. 19, 1984.

[30] Foreign Application Priority Data

Oct. 21, 1983 [JP] Japan ..... 58-197965
Oct. 24, 1983 [JP] Japan ..... 58-164188[U]
Oct. 24, 1983 [JP] Japan ..... 58-164189[U]

[51] Int. Cl.[4] ..... H01H 9/02; H01H 9/04

[52] U.S. Cl. ..... 200/306; 200/302.1; 220/373

[58] Field of Search ..... 200/306, 302.1; 220/373, 371, 89 A, 71

[56] References Cited

U.S. PATENT DOCUMENTS

| | | | |
|---|---|---|---|
| 3,090,848 | 5/1963 | Scholz | 200/83 V |
| 3,127,586 | 3/1964 | Heyn | 340/60 |
| 3,336,457 | 8/1967 | Julian et al. | 200/306 |
| 3,372,372 | 3/1968 | Carpenter | 340/71 |
| 3,507,708 | 4/1970 | Vignaud | 220/373 |
| 3,515,308 | 6/1970 | Hayes et al. | 220/89 A |
| 3,660,626 | 5/1972 | Kawamura et al. | 200/302.1 |
| 3,804,324 | 4/1974 | Sinn et al. | 220/71 |
| 4,207,913 | 6/1980 | Fike, Jr. | 220/89 A |
| 4,296,287 | 10/1981 | Boulanger | 200/83 P |
| 4,298,135 | 11/1981 | Vossen | 220/371 |
| 4,330,695 | 5/1982 | Poling | 200/83 P |
| 4,348,993 | 9/1982 | Ueno et al. | 200/19 DC |
| 4,524,254 | 6/1985 | Yoshida et al. | 200/306 |
| 4,545,340 | 10/1985 | Schreiner | 200/306 |

*Primary Examiner*—Henry J. Recla
*Assistant Examiner*—Linda J. Sholl
*Attorney, Agent, or Firm*—Finnegan, Henderson, Farabow, Garrett, & Dunner

[57] ABSTRACT

Disclosed is a pressure switch which comprises a body, a metal support with a part thereof embedded in the body, the support having an attachment portion outside the body to be attached to an external portion, a fixed contact portion formed on the support and disposed at the inside of the body, a diaphragm provided at the inside of the body for receiving a pressure from a pressure source and for being displaced in response to the pressure received, and a movable contact responsive to the displacement of the diaphragm to thereby constitute a switch in cooperation with the fixed contact portion.

3 Claims, 4 Drawing Sheets

PRESSURE SWITCH

This is a division of application Ser. No. 06/662,890, filed Oct. 19, 1984.

BACKGROUND OF THE INVENTION

1. Field of the Invention

The present invention relates to a pressure switch in which a switch provided in a body is electrically conducted with an attachment portion for attaching the body to a predetermined portion.

2. Description of the Prior Art

Conventionally, in such a pressure switch, a fixed. contact of a switch is connected to the inside of a metal body which is attached to a metal attachment plate and the attachment plate is, in turn, attached to a predetermined portion, so that the switch is electrically conducted with the predetermined portion through the attachment plate.

In the thus constructed pressure switch, however, there has been a problem that it is necessary to make the body of metal so that the pressure switch is heavy in weight and expensive in cost.

Further, conventionally, in the pressure switch of this kind, a switch cover is air-tightly attached to a switch body so as to cover a connection terminal portion of the body and lead wires led out from the connection terminal portion are rendered to airtightly pass through the switch cover. The switch cover is made of a sufficiently flexible material, such as rubber and is arranged such that, when the air inside the switch cover is expanded/-contracted, the switch cover per se is elastically deformed so as to prevent a pressure difference from occurring between the outside and inside of the switch cover. In the case where the pressure switch is mounted at a portion of severe conditions, such as an engine room of a automotive vehicle or car, where the surrounding temperature changes extremely, there is a problem that the elastic deformation of the switch cover becomes impossible to follow the expansion/contraction of the air inside the switch cover and the moisture outside the switch cover is sucked into the switch cover through the lead wire leading-out portion, etc., so that the humidity in the switch cover becomes higher.

SUMMARY OF THE INVENTION

The present invention has been attained in such circumstances and an object thereof is to provide a pressure switch in which a switch can be electrically conducted with an attachment portion without using a metal body and the pressure switch is light in weight and inexpensive in manufacturing cost.

Another object of the present invention is to provide a switch cover in which a pressure difference between the inside and outside of a switch cover is prevented from occurring even if the surrounding temperature changes extremely, thereby preventing moisture from entering the inside of the switch cover.

According to one aspect of the present invention, the pressure switch comprises a body integrally molded with a synthetic resin material, a metal support with a part thereof embedded in the body by being insert or outsert molded to be integrated with the body when the body is molded, the support having an attachment portion outside the body to be attached to an external attached portion, a fixed contact portion formed on the support and disposed at the inside of the body, a diaphragm provided at the inside of the body for receiving a pressure from a pressure source and for being displaced in response to the pressure received, and a movable contact arranged to become in contact with and separate from the fixed contact portion in response to the displacement of the diaphragm.

According to another aspect of the present invention, the pressure switch comprises a body integrally molded with a synthetic resin material, a metal support with a part thereof embedded in the body by being insert- or outsert-molded to be integrated with the body when the body is molded, the support having an attachment portion outside the body to be attached to an external attached portion, an electrode portion formed on the support and disposed at the inside of the body, a diaphragm provided at the inside of the body for receiving a pressure from a pressure source and for being displaced in response to the pressure received, and a movable contact attached on the diaphragm and responsive to the displacement of the diaphragm, an insulator attached on the body and provided with a fixed contact which constitutes a switch in cooperation with the movable contact, and a spring providing electrical conduction between the movable contact and the electrode portion.

According to a further aspect of the present invention, the switch cover comprises a cover body of a macro-molecular material provided on a switch body of such as a pressure switch to cover a connection terminal portion of the switch body, the cover body having a lead-out portion for allowing a lead wire led out from the connection terminal portion to pass therethrough, a vent hole formed in the cover body to cause the inside of the cover body to communicate with the outside of the same, and a film integrated with the cover body when the cover body is molded and disposed to cover the vent hole, the film having characteristics of ventilation as well as water-proof.

The above and other objects and the features of the present invention will be apparent when read the following description in conjunction with the accompanying drawing.

DESCRIPTION OF PREFERRED EMBODIMENTS

Figure 1:
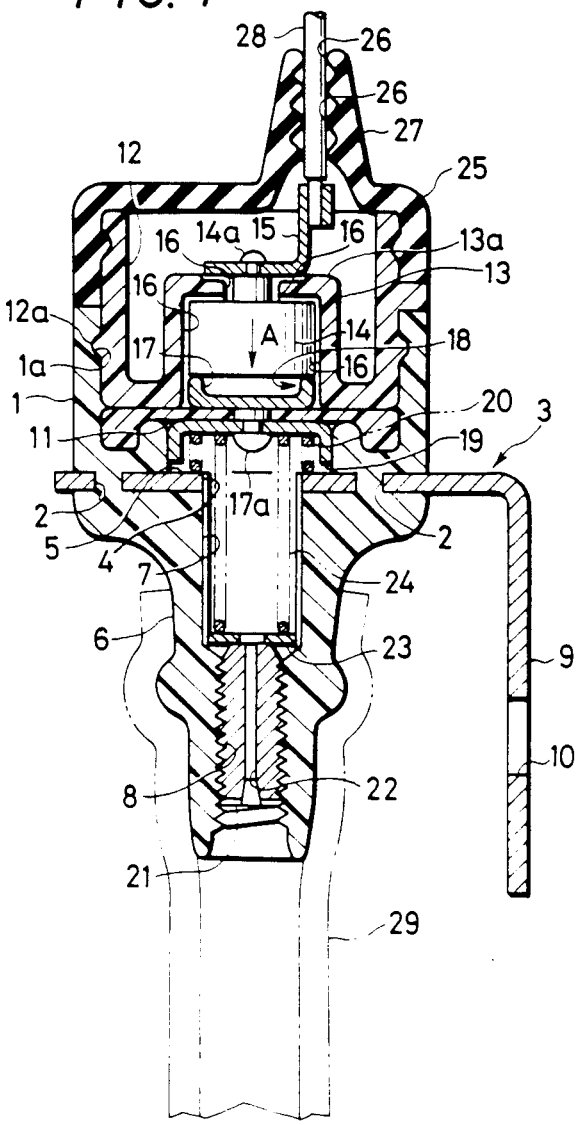
FIG. 1 is a cross-section showing an embodiment of the pressure switch according to the present invention.

Referring now to FIG. 1, an embodiment of the present invention will be described below.

In a container-like body 1 made of synthetic resin with an open top, a support 3 is embedded through outsert-molding, the support 3 comprising a metal plate formed with a plurality of resin paths 2. The upper-surrounding portion of a vent hole 4 formed in the support 3 is exposed at the inside of the body 1 to from an electrode portion 5. A cylindrical member 6 is projectingly integrally provided on the bottom portion of the body 1. The inside of the cylindrical portion is communicated with the vent hole 4 of the support member 3 to form a pressure chamber 7. A threaded portion 8 is formed in the inner circumference of the cylindrical member 6. An attachment portion 9 having an attaching hole 10 is formed by bending the support 3 at the outside of the body 1, and the body 1 is attached to a predetermined attachment portion (not shown) through the attachment portion 9.

A diaphragm 11 blocking the top surface of the pressure chamber 7 and an insulator 12 made of an insulation material are arranged such that an engagement protrusion 12*a* formed at the outer periphery of the insulator 12 is engaged with an engagement recess 1*a* formed at the inner periphery of the body 1 so that the lower part of the inner peripheral portion of the insulator 12 is fitted with the inner periphery of the body 1 and the lower surface portion of the outer bottom portion of the insulator 12 is in intimate contact with the upper circumferential portion of the diaphragm 11.

A container portion 13 is formed in the insulator 12 such that it is raised from the bottom wall portion of the insulator 12 and opened at its lower portion. A cylindrical fixed contact 14 is disposed in the container portion 13. An upper wall 13*a* of the container portion 13 is sandwiched between the internal fixed contact 14 and an external terminal 15 to which a protrusion portion 14*a* formed on the upper surface of the fixed contact 14 is press-deformed, with a vent gap 16 formed around the protrusion portion 14*a*.

A cup-like movable contact 17 is located also in the container portion 13, with its peripheral portion being in opposition to the fixed contact 14 and its bottom wall portion being in contact with the diaphragm 11. A switch 18 is constituted by the movable and fixed contacts 17 and 14. A cup-like conductive member 19 is disposed in the pressure chamber 7 such that the outer peripheral portion thereof is in opposition to the electrode portion 5 of the support 3. The cup-like conductive member 19 is integrated with the movable contact 17 with the diaphragm 11 sandwiched therebetween by deforming a protrusion portion 17*a* projectingly formed on the bottom wall portion of the movable contact 17 and passed through the diaphragm 11.

A spring 20 is provided between the conductive member 19 and the electrode portion 5 to provide electrical conduction therebetween. An adjustment screw 21 is provided with a vent hole 22 and threaded into the threaded portion 8 of the body 1. A spring seat 23 is in contact with the tip end portion of the adjustment screw 21 and a spring 24 is provided between the spring seat 23 and the conductive member 19. The movable contact 17 is urged by the spring force of the spring 24 against the fixed contact 14 to cause the switch 18 to be in its closed state.

A rubber cap 25 is fitted to the upper half portion of the insulator 12 such that the peripheral end portion of the cap 25 is contact with the body 1. A cylindrical lead-out portion 27 having a plurality of seal lips 26 formed on the inner surface thereof is projectingly provided on the upper surface of the cap 25. A lead wire 28 is connected to the terminal 15, water-tightly passing through the lead-out portion 27 of the rubber cap 25. A connection pipe 29 is provided for connecting a pressure source (not shown) and the pressure chamber 7.

The operation of the thus arranged pressure switch will be described hereunder. When a pressure does not act onto the inside of the pressure chamber 7, the diaphragm 11 is urged in the opposite direction to an arrow A in the drawing by the spring force of the springs 20 and 24 as described above, so that the movable contact 17 is pressed against the fixed contact 14 to hold the switch 18 in its closed state and the lead wire 28 is conducted with the attachment portion 9 to form an electric circuit through the terminal 15, the protrusion portion 14*a*, the fixed contact 14, the movable contact 17, the protrusion portion 17*a*, the conductive member 19, the spring 20, and the electrode portion 5.

On the other hand, when the pressure in the pressure source is lowered and the pressure in the pressure chamber 7 is reduced to a negative pressure which is lower than the atmospheric pressure, the diaphragm 11 is urged in the direction of arrow A in the drawing. When the urging force in the direction A due to the negative pressure becomes larger than the sum of the spring forces of the respective springs 20 and 24, the movable contact 17 moves in the direction of arrow A apart from the fixed contact 14 to make the switch 18 be in its opened state.

In the thus arranged embodiment as described above, since a part of the support 3 embedded in the body 1 is formed as the electrode portion 5 and the electrode portion 5 is electrically conducted with the movable contact 17 through the spring 20 and the conductive member 19, it is possible to make the movable contact 17 of the switch 18 electrically conduct with the attached portion merely by attaching the attachment portion of the support 3 to the predetermined portion, so that the body 1 can be made of a synthetic resin, material without using metal and can be made to be light in weight and inexpensive in cost.

The present invention is not restricted to the embodiment as described above. For example, a part of the support 3 is embedded in the body 1 by insert-molding instead of embedding the support 3 in the body 1 by outsert-molding. Thus, without departing from the spirit and gist of the invention, various modifications of the embodiment can be made.

As described above, the pressure switch according to the present invention comprises a support embedded in and integrated with a body by being insert-/outsert-molded when the body is molded with synthetic resin, an attachment portion formed in the support at a portion outside the body for being attached to a predetermined portion, an electrode portion formed inside the body, a diaphragm attached inside the body and arranged to be displaced in response to a pressure received from a pressure source, a movable contact attached to the diaphragm to be responsive to the displacement of the diaphragm, an insulator attached to the body and provided with a fixed contact which constitutes a switch in cooperation with the movable contact, a spring providing electrical conduction between the movable contact which moves together with the diaphragm and the electrode portion, whereby it is possible to electrically conduct the switch with the attachment portion by attaching the attachment portion of the support to the predetermined portion, so that it is not necessary to use a metal body and the switch can be made to be light in weight and can be produced inexpensively.

Figure 2:
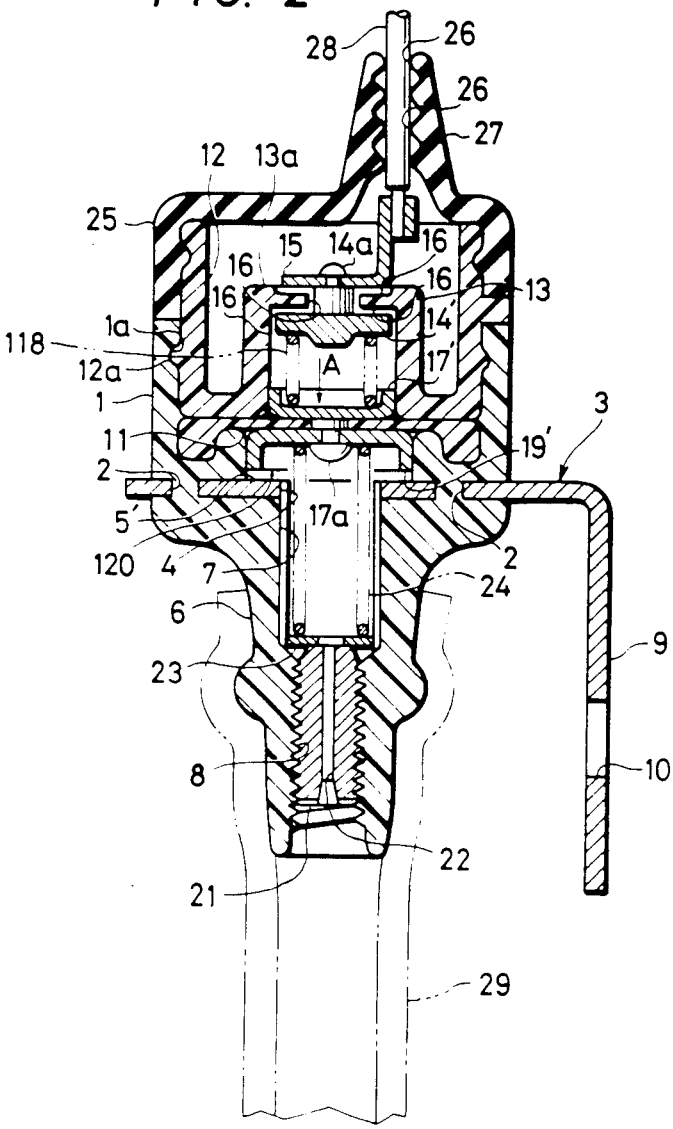
FIG. 2 is a cross-section showing another embodiment of the pressure switch according to the present invention.

Referring to FIG. 2, another embodiment of the present invention will be described hereunder. In FIG. 2, the same or corresponding part as that in the FIG. 1 embodiment is designated by the same reference numeral. An upper wall 13*a* of a container portion 13 which is formed such that it is raised from the bottom wall portion of the insulator 12 and opened at its lower portion is sandwiched between an internal first fixed contact 14' and an external terminal 15 to which a protrusion portion 14*a* formed on the upper surface of the first fixed contact 14' is deformed or caulked, with a vent gap 16 formed around the protrusion portion 14*a*. A first spring 118 is provided between a conductive member 17' and the first fixed contact 14'. A cup-like movable contact 19' is located in a pressure chamber 7, with its peripheral portion being in opposition to a fixed contact portion 5'. The movable contact 19' is integrated with the conductive member 17' with a diaphragm 11 sandwiched therebetween by caulking or deforming a protrusion portion 17*a* projectingly formed on the bottom wall portion of the conductive member 17' passing through the diaphragm 11. A switch 120 is constituted by the fixed contact portion 5' formed in the support 3 and the movable contact 19'. A second spring 24 is provided between a spring seat 23 and the movable contact 19' and the spring force of this second spring 24 is set to be larger than the spring force of the first spring 118 so that the movable contact 19' is normally separated from the fixed contact portion 5'.

The operation of the thus arranged pressure switch will be described hereunder. When the pressure in the pressure source is lowered and the pressure in the pressure chamber 7 is reduced to a negative pressure which is lower than the atmospheric pressure, the diaphragm 11 is urged in the direction of arrow A in the drawing. When the sum of the urging force in the direction A due to the negative pressure and the spring force of the first spring 118 becomes larger than the spring force of the second spring 24, the movable contact 19' moves in the direction of arrow A and comes in contact with the fixed contact portion 5' to make the switch 120 be in its closed state so that a lead wire 28 is conducted with the support 3 through a terminal 15, the fixed terminal 14', the first spring 118, the conductive member 17', the protrusion portion 17*a*, the movable contact 19', and the fixed contact portion 5', and further conducted with an attached portion through an attachment portion 9, to thereby form an electric circuit.

In the thus arranged embodiment as described above, formed as the fixed contact portion 5', it is possible to make the fixed contact portion 5' of the switch 120 electrically conduct with the attached portion merely by attaching the attachment portion 9 of the support 3 to the predetermined portion, so that the body 1 can be made of a synthetic resin material without using metal and can be made to be light in weight and inexpensive in cost.

The present invention is not restricted to the embodiment as described above. For example, a part of the support 3 is embedded in the body 1 by insert-molding instead of embedding the support 3 in the body 1 by outsert-molding. Further, the spring force of the second spring 24 may be set to be smaller than that of the second spring so that the movable contact 19' is made to be normally in contact with the fixed contact portion 5' while the former is separated from the latter when a pressure larger than the atmospheric pressure acts in the pressure chamber 7. Furthermore, it is possible to parallelly provide a plurality of bodies 1 on the support 3 to thereby form a plurality of switches so that these switches perform their on/off operations at different pressures.

Figure 3:
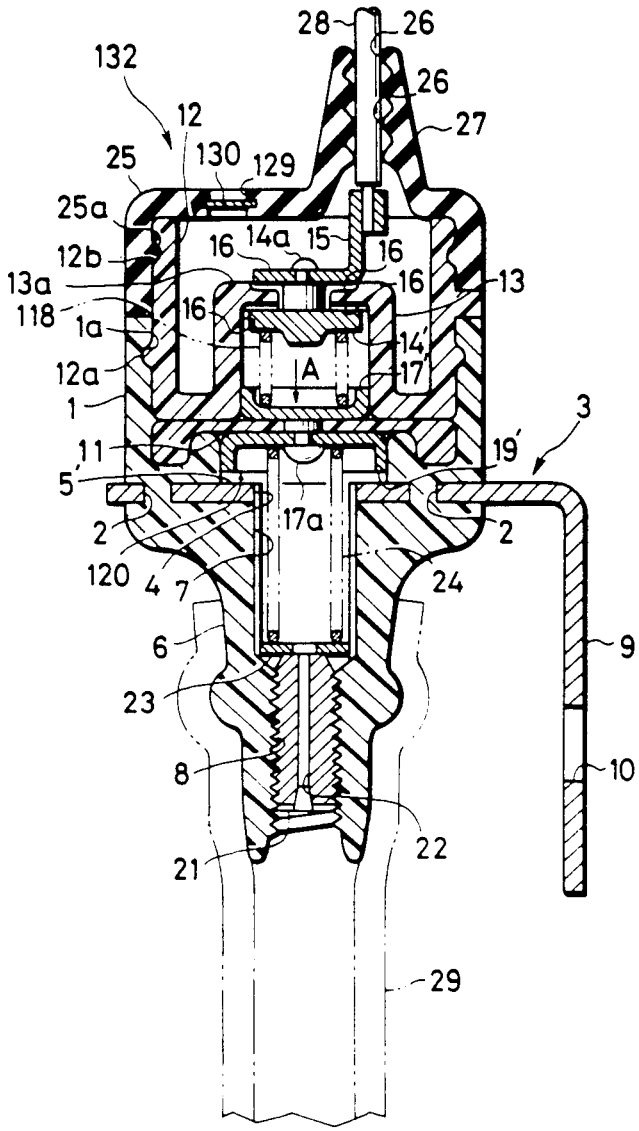
FIGS. 3 to 5 are views showing a further embodiment of the pressure switch according to the present invention.
Figure 4:
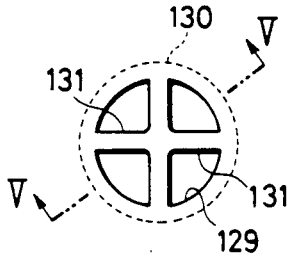
Figure 5:
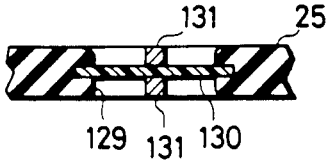

FIG. 3 shows a further embodiment of the pressure switch according to the present invention. In FIG. 3, the same reference numeral as used in FIG. 2 designates the same part as that in FIG. 2. Referring to FIGS. 3 to 5, this embodiment will be described hereunder.

A container-like cover body 25 made of a macromolecular material such as rubber with its lower end opened is air-tightly fitted to the outer periphery of a body 1 by causing an engagement protrusion portion 25*a* formed on an inner peripheral wall of cover body 25 to engage with an engagement recess 12*b* formed in the outer peripheral wall of an insulator 12. A lead wire 28 connected to a terminal 15 is fitted into seal lips 26 and air-tightly passed through a lead-out portion 27. In FIGS. 4 and 5, a vent hole 129 is formed in the top surface of the cover body 25 which is covered by a film 130. The film 130 may be, for example, a porous Tefron® (polytetrafluoroethylene) film (trade name: Gore-tex) of characteristics of ventilation as well as water-proof. The peripheral edge of the film 130 is embedded in the cover 25 when the cover body 25 is molded and held from its opposite sides by cruciform holders 131 so as to be integrated with the cover 25. Thus, a switch cover 132 is constituted by the cover body 25, the leadout portion 27, the vent hole 129, and the film 130.

When the pressure of a pressure source increases to increase the pressure in a pressure chamber 7, a diaphragm 11 is displaced in the direction opposite to the direction of arrow A to cause a movable contact 19' to separate from a fixed contact portion 5' to open a switch 120. Thus, when the volume in a container portion 13 due to the displacement of the diaphragm 11, the air in the cover body 25 moves through a gap 16 so that the inside of the container 13 is maintained at the atmospheric pressure. Further, when the temperature surrounding the cover body increases to thereby expand the air in the cover body 25 and if the pressure in the cover body 25 becomes higher than the atmospheric pressure, the air in the cover body 25 is discharged outward through the film 130 provided to cover the vent hole 129 to thereby equalize the pressure between the inside and outside of the cover body 25. If the air in the cover body 25 is contracted due to the falling of the temperature surrounding the cover body so that the pressure in the cover body 25 becomes lower than the external pressure, the external air flows into the cover body 25 through the film 130 provided to cover the vent hole 129 to thereby equalize the pressure between the inside and outside of the cover body 25.

In this embodiment, since the cover body 25 is provided with the vent hole 129 covered with the film 130 of the characteristics of ventilation as well as waterproof, air is allowed to flow into or out of the cover body 25 when the surrounding temperature rises to expand the air in the cover body 25 or when the surrounding temperature falls to contract the air in the cover body 25, so that external moisture is prevented from entering the inside of the cover body 25. Even if water drops fall on the cover body 25, they are prevented from entering the inside of the cover body 25 because of the film 130 has characteristics of waterproof as well as ventilation.

Figure 6:
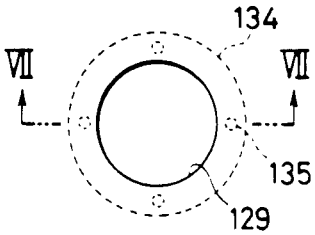
FIG. 6 is a plan view showing a still further embodiment of a switch cover according to the present invention.
Figure 7:
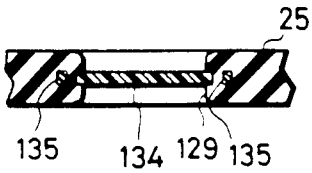
FIG. 7 is a cross-sections showing the switch cover shown in FIG. 6.

FIGS. 6 and 7 show another embodiment of the cover. As shown in FIGS. 6 and 7, instead of providing the holders 131, holding holes 135 are previously formed in the outer peripheral edge portion of a film 134 so that when a cover body 25 is molded, a rubber material forming the cover body 25 is filled such that it passes through the holding holes 135 to thereby integrate the cover body 25 with the film 134.

As described above, according to the present invention, a vent hole is formed in an elastic cover body of a macro-molecular material to communicate the inside with the outside of the cover body and a film of the characteristics of ventilation as well as water-proof to cover the vent hole is provided integrally with the cover body when the cover body is molded, so that it is possible to equalize the pressure between the inside and outside of the cover body to thereby prevent moisture from entering the inside of the cover body.

What we claimed is:

1. A switch cover for a switch body having a lead wire extending outside of the switch from a connection terminal portion comprising:

a molded cover body of a macro-molecular material deformably resistant in response to temperature and pressure changes outside of the switch, said cover body being provided on the switch to cover the connection terminal portion of the switch body, said cover body having a lead-out portion for allowing the switch lead wire to pass therethrough;

a vent hole formed in said cover body to cause the inside of said cover body to communicate with the outside;

a thin, flexible film disposed to cover said vent hole, said film having characteristics of gas permeability and water-proofness, said film having opposed surfaces; and means for integrating said film with said molded cover body when said cover body is molded, and two rigid holders supporting said film, each rigid holder extending over said vent hole to support one of said opposed film surfaces.

2. The switch cover according to claim 1, wherein said film is made of microporous polytetrafluoroethylene material.

3. The switch cover according to claim 1 wherein said holders include holder arm portions extending across said opposed surfaces of said film.

* * * * *